US006557351B1

(12) United States Patent
Ghedini et al.

(10) Patent No.: US 6,557,351 B1
(45) Date of Patent: May 6, 2003

(54) SUPPORT FOR SUPPORTING AN ICE BEAKER IN USE

(75) Inventors: Lauro Ghedini, Bologna (IT); Mario Montanari, Bologna (IT)

(73) Assignee: Reale S.r.l., Bologna (IT)

( * ) Notice: Subject to any disclaimer, the term of this patent is extended or adjusted under 35 U.S.C. 154(b) by 0 days.

(21) Appl. No.: 09/720,747

(22) PCT Filed: Jun. 28, 1999

(86) PCT No.: PCT/IT99/00192

§ 371 (c)(1),
(2), (4) Date: Apr. 20, 2001

(87) PCT Pub. No.: WO00/00066

PCT Pub. Date: Jan. 6, 2000

(30) Foreign Application Priority Data

Jun. 29, 1998 (IT) ..... BO98A0395

(51) Int. Cl.[7] ..... F25D 3/08; B65D 23/12
(52) U.S. Cl. ..... 62/1; 62/457.3; 215/393
(58) Field of Search ..... 62/1, 457.3, 330, 62/457.2, 272, 285; 215/393

(56) References Cited

U.S. PATENT DOCUMENTS 929,389 A * 7/1909 Clement ..... 62/457.3
2,048,041 A * 7/1936 Warren et al. ..... 62/1
2,838,916 A * 6/1958 Planes Y Sola ..... 62/457.3
2,921,706 A * 1/1960 Johnson ..... 215/393
2,945,361 A * 7/1960 Miller ..... 62/1
2,952,133 A * 9/1960 Miller ..... 62/457.3
2,961,849 A * 11/1960 Hitchcock ..... 62/1
3,065,606 A * 11/1962 Reynolds ..... 62/457.3
3,279,638 A * 10/1966 Merry ..... 215/393
4,543,801 A * 10/1985 Damiens ..... 62/1
4,625,518 A * 12/1986 Freedman ..... 62/1
5,177,981 A * 1/1993 Haas ..... 62/1
5,250,315 A * 10/1993 Loew et al. ..... 426/515

* cited by examiner

*Primary Examiner*—William C. Doerrler
(74) *Attorney, Agent, or Firm*—Sughrue Mion, PLLC

(57) ABSTRACT

A support for an ice-beaker comprising a cup-shaped body with a side wall and a base for collecting the water resulting from the progressive melting of an ice beaker housed in the cup-shaped body. The side wall comprises regions, arranged spaced apart on the side wall, for support and restraining the outer wall of an ice beaker. The ice beaker can be produced by an ice-making machine comprising a condensation plate with housings for receiving atomized to form frozen elements. Each housing of the condensation plate comprises a conical side wall and a base wall, the taper of the side being sufficiently wide to bring about the formation of a frozen element which has a central cavity so as to be generally beaker-shaped. In the production method, an intermediate waiting step of predetermined duration is interposed between the interruption of the cooling and the start of the heating of the condensation plate.

22 Claims, 8 Drawing Sheets

SUPPORT FOR SUPPORTING AN ICE BEAKER IN USE

BACKGROUND OF THE INVENTION

The present invention relates to the field of ice beakers. The invention has been developed, in particular with regard to moulds for producing ice beakers and to a support for supporting such a beaker in use.

German utility model DE 296 09 553 U relates to a support for use for ice beakers and to a system for producing them by means of complementary male and female moulds. It is known, from this document, to arrange the male and female moulds in a manner such that when they are coupled they form a series of cavities to be filled with water. A hen the water is frozen, it forms beaker-shaped frozen structures which are removed by separating the male mould from the female mould. In order to use an ice beaker of this type it is necessary to provide a respective support which supports the beaker and possibly collects the water which is produced as the beaker gradually melts. Naturally, the support must be formed in a manner such that the water collected does not escape from the support when the support and the ice beaker are inclined for drinking.

The above-mentioned utility model describes and illustrates a type of metal support with a frusto-conical body supported by a hollow stem in which the water produced as the ice beaker melts is collected. The side walls of the frusto-conical body widen out from the stem and are inclined in a manner substantially similar to the inclination of the walls of the ice beaker to be housed in the support. Extending from the upper edge of the frusto-conical support are elongate appendages at the ends of which stop pins are formed for welding to the outer wall of the ice beaker in order to hold it in position relative to the support, both in the erect position of the support and in the inclined position adopted by the support and by the ice beaker during drinking.

Known supports have many disadvantages, the first of which is the fact that the ice beaker is not stable inside the support and, in particular, tends to move to and fro to a greater extent the more its outer wall has melted. Moreover as the ice beaker melts it also tends to move down towards the base of the support so that its to and fro movements can lead to some portions of the outer wall of the ice beaker moving towards the side wall of the support until they touch it; in this condition, some of the water of the melting ice beaker may find its route towards the base or stem of the support obstructed and may overflow from the support. This dripping outside the support is added to the condensation which forms on the outside of the support because of the intense cooling due to direct contact with the ice, possibly over quite large areas.

Another disadvantage of known supports is that it is difficult to remove all of the water held in the supports when they are being prepared for subsequent use. The presence of the partition in fact gives rise to an undercut which prevents the water from escaping not only whilst the support is in use, which is desirable, but also after use when the ice beaker has completely melted.

Another disadvantage of the known supports is that the cost of the ice beaker is considerably less that that of the support, which has to be re-used over and over again. This renders the use of the supports of known type disadvantageous when it is not possible to check that they are all returned after use, for example, in crowded locations such as discotheques, swimming pools, beaches, sports stadia, and the like.

A further disadvantage of known supports is that they are quite complex to manufacture and bulky to store. Moreover, the aesthetic form of these supports is defined at the production stage and it is therefore particularly expensive to differentiate production in order to offer for sale supports of various shapes and styles.

More generally, in addition to the drawbacks connected with known supports, the use of ice beakers is not very widespread because of the substantially small-scale and complex production technique of the beakers themselves. Productivity for ice beakers produced by known techniques is generally low which limits their distribution in locations much frequented by the public. Moreover, for the domestic use of ice beakers in which the limited number of ice beakers which can be produced by conventional techniques would not be a critical factor for their distribution, the considerable bulkiness of the known male and female moulds, combined with the need to provide special supports also restricts the distribution of ice beakers in the domestic field.

SUMMARY OF THE INVENTION

An object of the present invention is to overcome the drawbacks of the prior art, first of all by proposing a support for an ice beaker which is easy to store or in any case compact, easy to use and of pleasant appearance. A further object of the invention is to propose a support for an ice beaker which supports an ice beaker firmly, even at an advanced stave of melting, and which drastically reduces the risk of water dripping out of the support. Another object of the invention is to provide a support of the type indicated above which is simple and inexpensive to produce so that its cost is quickly offset to the point at which it can even be used only once as a "disposable" product. A further object of the invention is to provide a support for an ice beaker which is aesthetically pleasing and which can be offered in aesthetic configurations of various types without this leading to high production or storage costs. Yet another object of the invention is to provide a mould for producing ice beakers which can easily also be used as a support for the ice beaker.

To achieve the objects indicated above, the subject of the invention is a support for an ice beaker with an inclined outer wall which is characterized in that it comprises regions, arranged spaced apart along the height of the beaker when it is in the upright position, for supporting and restraining the outer wall of an ice beaker.

In one embodiment, the supporting and restraining regions comprise projections arranged spaced apart on the side wall of a beaker-shaped body and oriented towards the interior thereof, the side wall of the support being inclined to an extent substantially equal to the inclination of the side wall of the ice beaker. Preferably, but not exclusively, the projections are formed integrally with the beaker-shaped body which can advantageously be produced by moulding of a plastics material, although the possibility of using other materials should not be excluded. The arrangement of the projections may adopt a configuration such as additionally to confer an aesthetic quality on the support.

An additional feature of the embodiment mentioned above is the presence of a flexible partition which can easily be removed from the support and which has the dual function of holding the water in the base of the support, even when the support is inclined for drinking, and of preventing the ice beaker from moving downwards in the support beyond a predetermined limit to prevent the ice from obstructing the regions in which the water flows towards the base of the support and/or to prevent the ice from coming into contact with relatively large areas of the side wall of the support.

In another embodiment, the support for an ice beaker comprises a spiral member the coils of which project inwardly relative to the side wall of the support. The spiral member conveys the water produced during the melting of the ice towards the base of the support and, at the same time, constitutes a barrier for the water which has collected in the base of the support when the support is inclined during drinking. The spiral member may be removable and, in this case, can be used in association with any conventional beaker the side wall of which is inclined to an extent substantially equal to the inclination of the side wall of the ice beaker. The spiral member may also be formed integrally on the side wall of a conventional beaker. In particular, it is possible to produce, in plastics material with programmed deformation, "disposable" beakers, the side walls of which can be deformed before use to form spiral recesses.

One of the advantages of the present invention is, in particular, that the ability to manufacture "disposable" supports in large quantities from inexpensive plastics material can favour the use of ice beakers in large quantities, particularly in locations much frequented by the public. In this case, the number of ice beakers which can be produced by conventional methods by means of male and female moulds could be inadequate, particularly in view of the fairly long periods of time which are required for the water to freeze in the cavities defined between the male and female moulds. To avoid this drawback, a further subject of the invention is an ice-making device particularly suitable for producing large quantities of ice beakers usable with a support of the type indicated above.

BRIEF DESCRIPTION OF THE DRAWINGS

Finally, a subject of the invention is a method of producing ice beakers, particularly for domestic use, in which the mould can act as a support for the ice beaker formed by freezing of the water in the mould.

Further characteristics and advantages will become clear from the following description of preferred embodiments described with reference to the appended drawings provided by way of non-limiting example, in which.

DETAILED DESCRIPTION OF THE INVENTION

Figure 1:
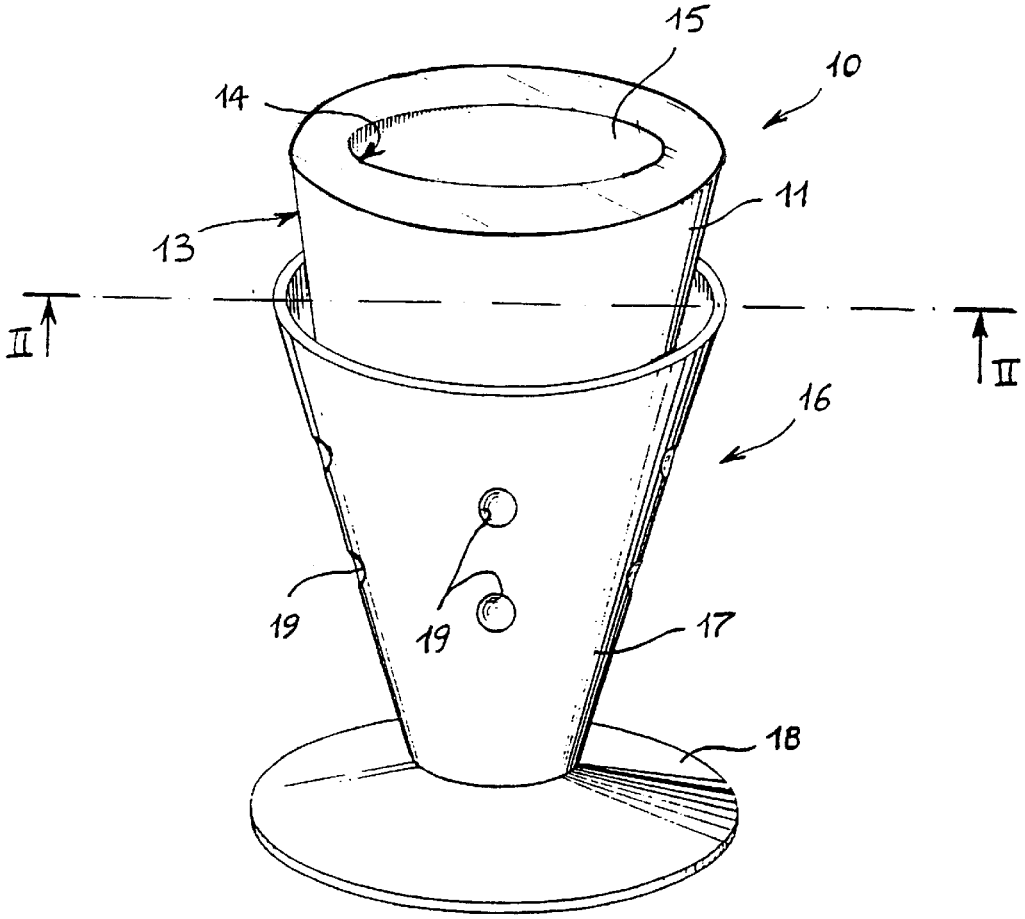
FIG. 1 shows, in perspective, a first embodiment of a support comprising projections arranged spaced apart on its side wall.
Figure 2:
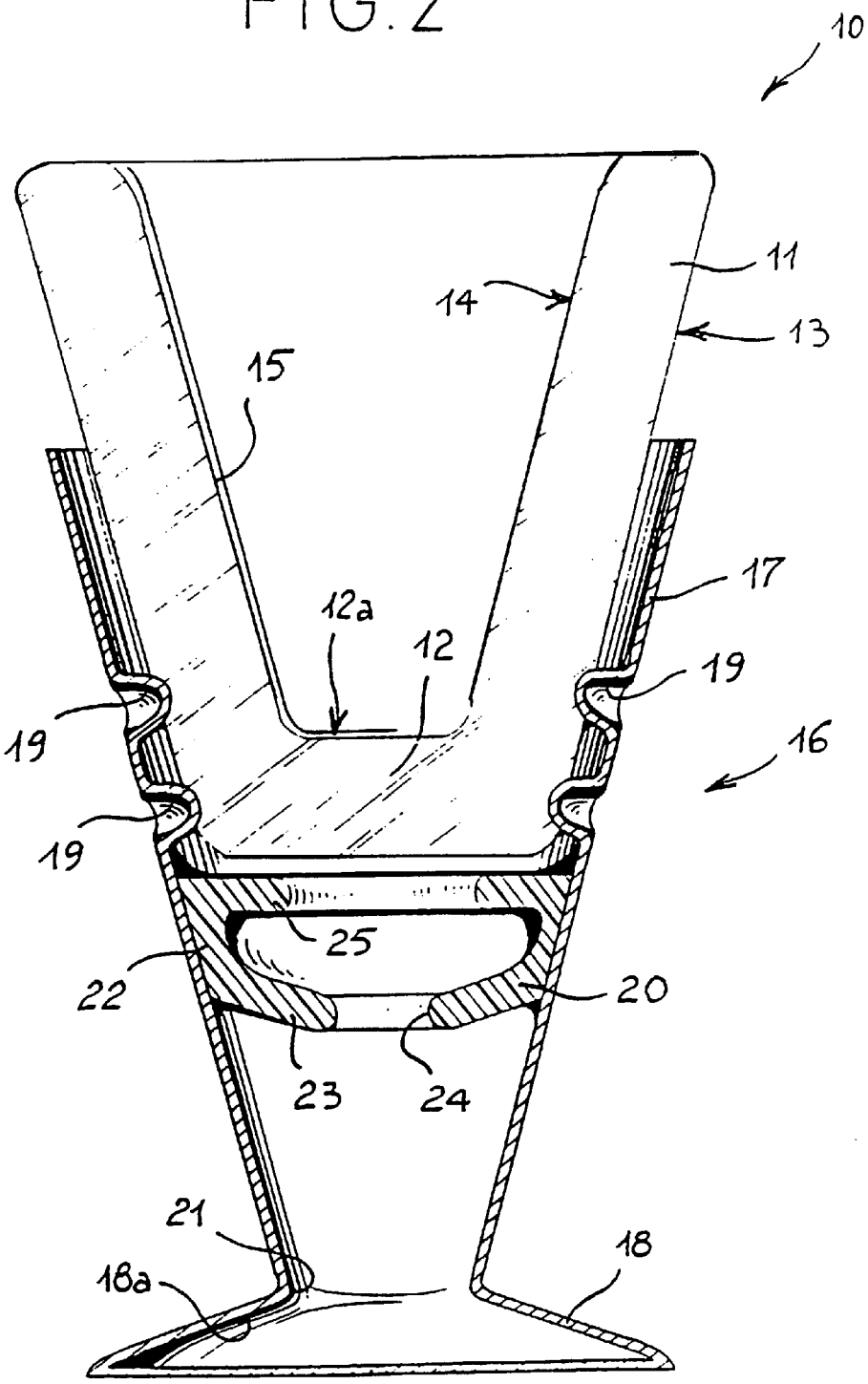
FIG. 2 is a section taken on the line II—II of FIG. 1.

With reference now to FIGS. 1 and 2, an ice beaker 10 comprises an inclined side wall 11, in particular, of frusto-conical shape, closed by a base 12, the whole being formed entirely of ice by means of known production methods, or of innovative methods described further below. The inclined side wall 11 comprises an outer surface 13 and an inner surface 14 which, together with the inner surface 12*a* of the base 12 defines a cavity 15 for holding a drink.

The ice beaker can be housed in a goblet-like support 16 comprising, a side wall 17 inclined to an extent substantially corresponding to the inclination of the side wall 11 of the ice beaker 10. In particular, the side wall 17 of the support 16 becomes narrower in its lower portion, where it is joined to a widened, hollow support fool 18 of the support 16. The internal cavity 18*a* of the foot 18 communicates, through an opening 21, with the internal space defined by the side wall 17. The goblet-like support 16 is preferably made of plastics material or of stainless steel, although the possibility of using materials of different types is not excluded.

Dimples 19 formed on the side wall 17 of the goblet-like support 16, for example, by moulding or punching, are spaced apart both peripherally along circles lying in the same horizontal plane, and in the vertical direction. The arrangement of the dimples 19 may adopt the regular form shown in FIGS. 1 and 2 in which, purely by way of example and without excluding the possibility of the formation of different configurations the upper and lower dimples are aligned along straight lines which are generatrices of the side wall 17 of the support 16.

Figure 3:
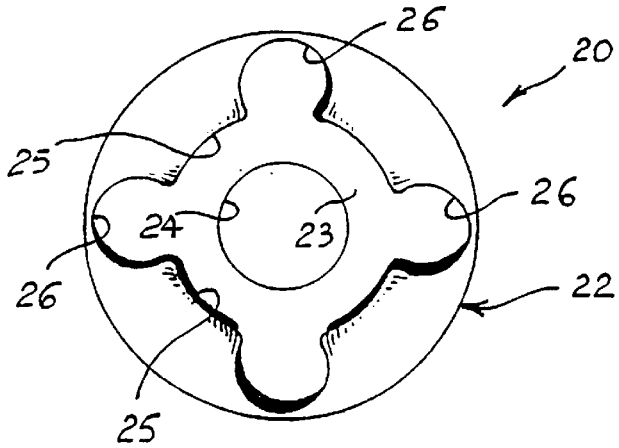
FIG. 3 is a plan view of a partition particularly suitable for use with the support of FIGS. 1 and 2.

Inside the support 16, beneath the rout of lower dimples there is an annular partition 20, preferably made of deformable or flexible material, for example, a silicone rubber suitable for use with foodstuffs. The annular partition 20 comprises a peripheral wall 22 from which a lower annular lip 23 extends and is inclined slightly downwards relative to a horizontal plane, defining a duct 24. Projecting appendages 25 which can best be seen in FIG. 3, extend from the top of the peripheral wall 22 and define peripheral ducts 20. Naturally, the shape and number of the projecting appendages 25 shown in the drawings is given purely by way of example.

In use, the ice beaker 10 is placed inside the goblet-like support 16 in a manner such that the outer surface 13 of the ice beaker bears against the dimples 19 in a plurality of support regions. The slight pressure exerted by the weight of the ice beaker 10 on the dimples 19, together with the difference in temperature between the regions in contact causes local melting of the surface 13 so that the dimples 19 penetrate the side wall 11 of the ice beaker slightly preventing it from moving to and fro and being displaced which could otherwise occur when the support 16, and the ice beaker therewith, are inclined by a user in order to drink or sip the product previously poured into the cavity 15.

The dimples 19 also keep the ice beaker spaced from the side wall 17 of the support 16 so as to form a space in which the water which is produced during the slow melting of the ice beaker can flow. The water drips through the peripheral ducts 26, runs over the lower lip 23 of the annular partition 20, and is collected in the base of the goblet-like support 16, in the cavity 18*a* of the foot 18.

The ice beaker can be used to drink the product contained therein as long as no cracks or holes are formed in the base 12 of the beaker because of the progressive melting of the ice. Until the melting reaches this advanced stage, the amount of water which collects in the base of the goblet-like support 16 is not excessive and is therefore stopped by the lower lip 23 of the partition 20 even when the goblet-like support 16 is inclined in order to drink from the ice beaker 10.

During the progressive melting, the side wall 11 of the ice beaker 10 becomes thinner and the beaker tends to move downwards relative to the support 16. The dimples 19, which are also spaced apart vertically, nevertheless ensure that the ice beaker 10 is well supported and prevent it from moving to and fro and being displaced inside the support 16 as long as excessive melting of the beaker does not prevent its further use for drinking. The downward movement of the ice beaker 10 relative to the goblet-like support 16 is in any case limited by the presence of the partition 20 and, in particular, by the projecting appendages 25 on which the base 12 bears until it is almost completely melted. When the base 12 of the ice beaker 10 is bearing on the projecting appendages 25, the water can still drip towards the base 18 by virtue of the presence of the peripheral ducts 26.

After use, the support 16 can be re-used after removal of the water which has collected in its base. For this purpose it suffices to remove the partition 20, for example by inserting a finger in the duct 24 and pulling towards the upper opening of the goblet-like support. The deformability or flexibility of the partition 20 together with the inclination of the side wall 17 and the fact that the dimples 19 do not project excessively renders the removal of the partition 20 and its subsequent re-insertion in the support 16 quite easy.

Figure 4:
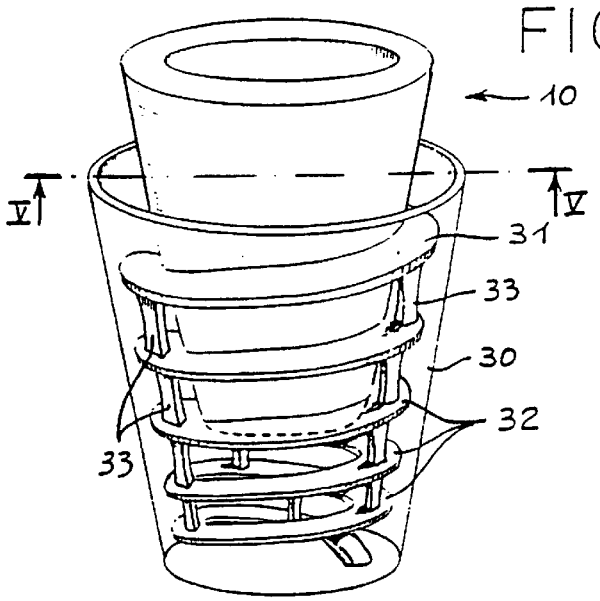
FIG. 4 shows, in perspective, another embodiment of the support, comprising a removable spiral element.
Figure 5:
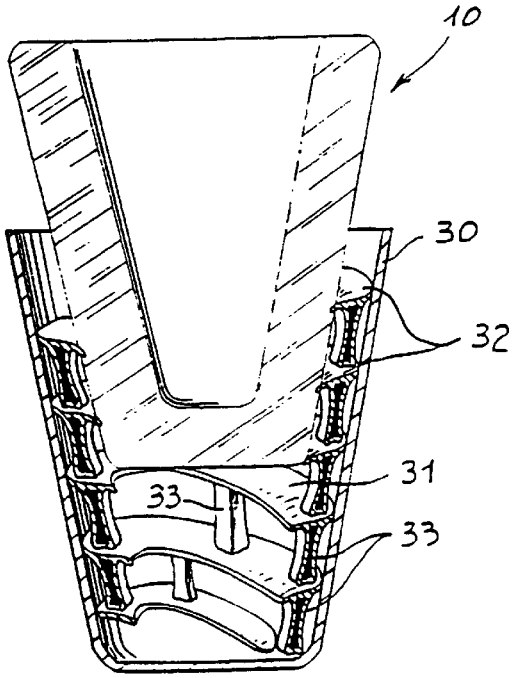
FIG. 5 is a section taken on the line IV—IV of FIG. 4.
Figure 6:
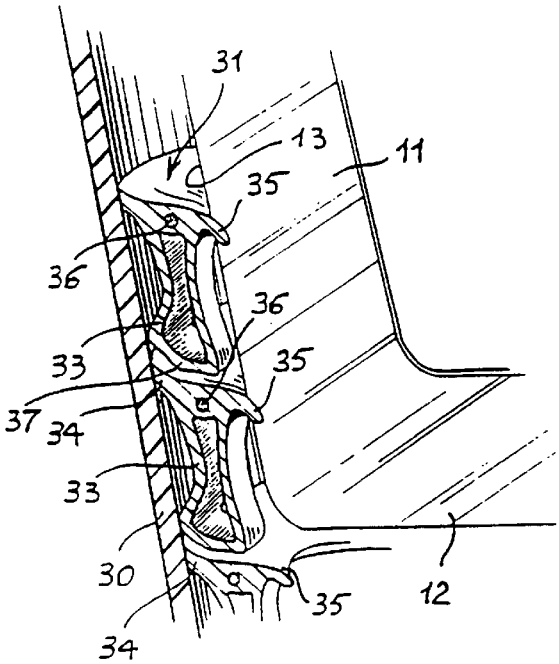
FIG. 6 is an enlarged view of a detail of FIG. 5, showing, a preferred configuration of the spiral element.

FIGS. 4, 5 and 6 show another embodiment of a support according to the present invention. The ice beaker 10 is supported inside a beaker-shaped body 30 which may even be a conventional glass or plastics beaker, in which a rigid or flexible spiral element 31 has previously been inserted. In particular, the drawings show, by way of non-limiting example, a flexible spiral element 31, for example made of silicone rubber suitable for use with foodstuffs, in which the coils 32 are spaced apart vertically by means of spacer feet 33, preferably formed integrally as appendages projecting from the coils 32.

FIG. 6 shows in detail the cross-section of a preferred embodiment of the spiral element 31, in which each coil 32 comprises an outer edge 34 which bears sealingly on the side wall of the beaker-like body 30 and an inner edge 35 on which the outer surface 13 of the side wall 11 of the ice beaker 10 bears. The cross-section of the coils 32 may incorporate an inner core 36 of more rigid material, for example a harmonic steel wire or a thread of resilient plastics material. The spacer feet 33 may in turn comprise respective bearing rims 37.

In use, the water which is produced during the progressive melting of the ice beaker 10 is collected by the spiral element 31 which directs it towards the base of the beaker-shaped body 30. When the beaker-shaped body 30 is inclined in order to drink from the ice beaker 10, the coils 32 of the spiral element 31 act as a barrier to the water, preventing it from escaping from the beaker-shaped body 30. During the melting and progressive thinning of its side wall 11, the ice beaker 10 moves gradually downwards in the beaker-shaped body 30, encountering ever narrower coils 32 which in any case prevent the ice beaker from moving, to and fro.

Figure 7:
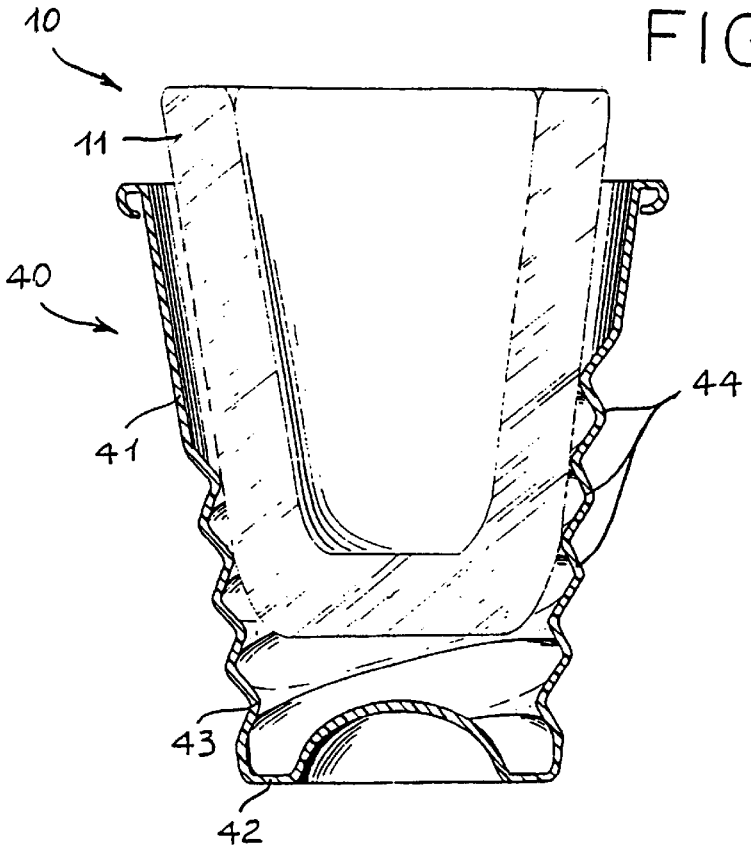
FIG. 7 is a longitudinal section through another embodiment of the support, of the "disposable" type, in the deformed, operative configuration in which the side wall is formed with a spiral.
Figure 8:
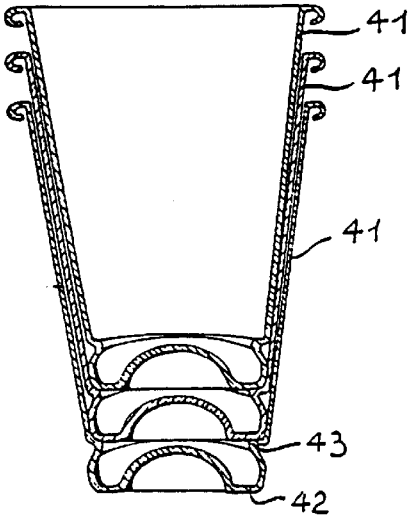
FIG. 8 shows in longitudinal section, a set of supports of the type shown in FIG. 7, in the storage or stowage configuration in which the side walls are undeformed.
Figure 9:
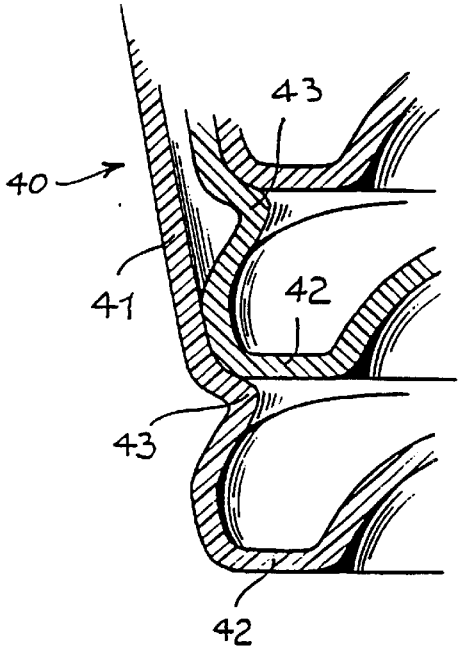
FIG. 9 shows a detail of FIG. 8, in section and on an enlarged scale.

In another embodiment shown in FIGS. 7, 8 and 9 a support 40 with programmed deformation is provided in the form of a "disposable" beaker, for example made of plastics material. As can be seen in detail in FIG. 9 initially the deformable support 40 has a substantially smooth frusto-conical side wall 41. An annular indentation 43 is preferably provided in the vicinity of the base 42 of the deformable support 41 to act as a spacer between one support and another in the storage and stowage configuration shown, so as to favour the removal and separation of one deformable support from another. Spiral deflection and deformation lines are predefined on the side wall 41 of the deformable support 40 so that, starting from the undeformed configuration of FIG. 8, slight squashing of the deformable support 40—possibly accompanied by slight twisting of the base 42 relative to the mouth—brings about the appearance of a spiral corrugation 44 in the side wall 41. It is thus possible to provide supports 40 in large quantities at a very low cost, enabling drinks to be supplied easily and inexpensively in ice beakers in locations much frequented by the public. The function of the deformable support 40 in use is substantially similar to that described above with reference to the spiral element 31 shown in FIGS. 4 to 6.

In order to provide large quantities of ice beakers 10, in particular but not exclusively for use in locations much frequented by the public, it may be advantageous to use an automatic ice-making machine, rather than to rely on the production of ice beakers in small batches by means of known methods using male and female moulds. Ice-making machines are generally known and will not therefore be discussed in detail. For the purposes of the present description, it suffices to note that these machines comprise a condensation plate comprising recesses, normally made of metal, more particularly, nickel-plated copper, against which jets of water are directed by means of ejectors disposed under the plates. The plate is cooled to a temperature such as to bring about freezing of the water and the formation of small cubes or blocks of ice inside the recesses. By raising the temperature of the plate above freezing point, the blocks of ice are detached from the recesses in the plate and fall into a collecting tank, ready for use.

In greater detail, known methods for producing ice by means of the above-mentioned machines comprise the steps of:

a) cooling the condensation plate, b) directing a flow of atomized water towards the condensation plate for a predetermined period of time sufficient to form frozen elements, c) interrupting the cooling of the condensation plate, and d) interrupting the flow of atomized water and heating the condensation plate to permit detachment of the frozen elements.

The Applicant has found that, for optimal production of ice beakers by the above-mentioned method, it is preferable to interpose between the interruption of the cooling, and the start of the heating of the condensation plate an intermediate waiting step of predetermined duration, preferably but in non-limiting manner of about 30 seconds. The flow of atomized water directed towards the condensation plate is preferably maintained during the intermediate waiting step. During the cooling step a), the duration of which is, for example, about 30 minutes, the condensation plate is cooled to a temperature of about −10_C.

One of the main advantages of this method consists of a reduction in the thermal shock to which the ice beakers are subjected, reducing the risks of breakage of the beakers.

Figure 10:
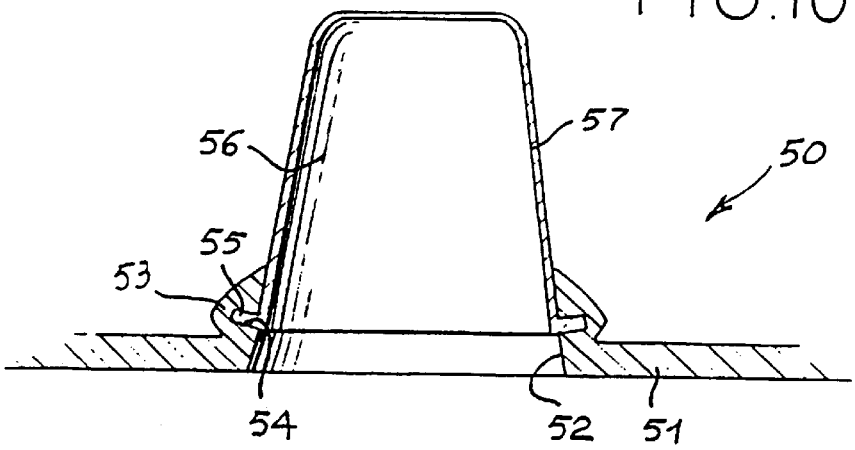
FIG. 10 shows, in section, an element of a condensation plate particularly for use in an automatic machine for the large-scale production of ice beakers.
Figure 11:
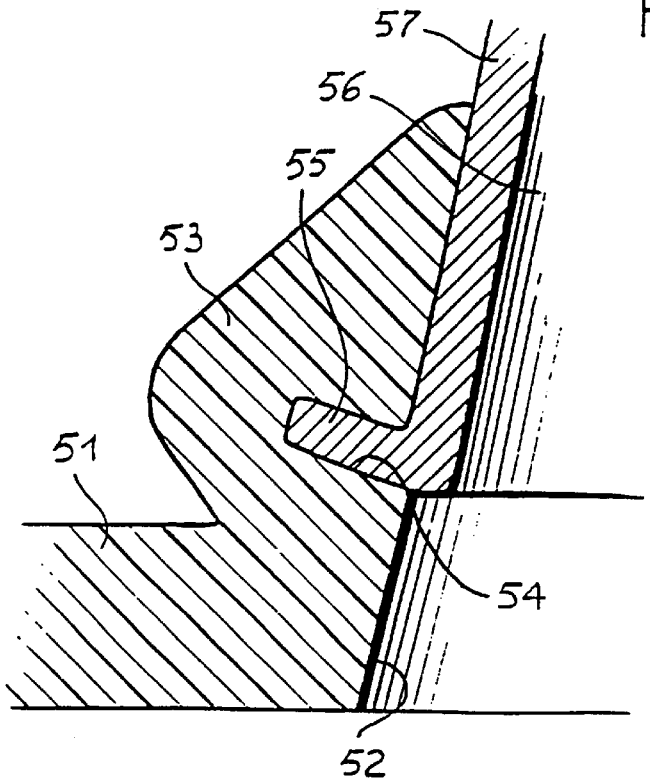
FIG. 11 shows a detail of FIG. 10, on an enlarged scale.

FIGS. 10 and 11 show a specific embodiment of a condensation plate 50 comprising a base 51, preferably, but in non-limiting manner, made of plastics material, for example ABS, arranged horizontally and having circular openings 52 each having a shaped rim 53 in which there is a peripheral notch 54 in which a collar 55 of a cup-shaped vessel 56 with a substantially conical side wall 57 is engaged. The maximum inside diameter of the side wall 57 is slightly less than the diameter of the circular opening 52 so as to favour the detachment of a conical ice beaker upon completion of its formation inside the cup-shaped vessel 56 as a result of the freezing of water supplied by ejectors disposed beneath it. The taper of the side wall 57 of the cup-shaped vessel 56 is such that the water supplied by the ejector freezes gradually following the shape of the side wall, leaving a central cavity for holding a liquid product to be drunk or sipped when the finished ice beaker is in use.

Figure 12:
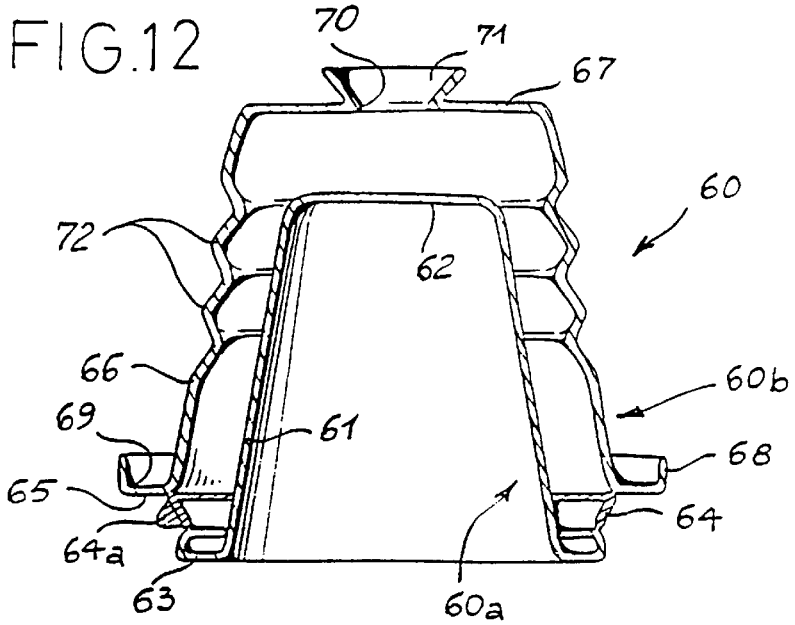
FIGS. 12 and 13 show, in section, the combination of a male mould and a female mould for producing ice beakers in single units and for their subsequent support, in the condition for producing the ice beaker, and in the condition of subsequent use, respectively.
Figure 13:
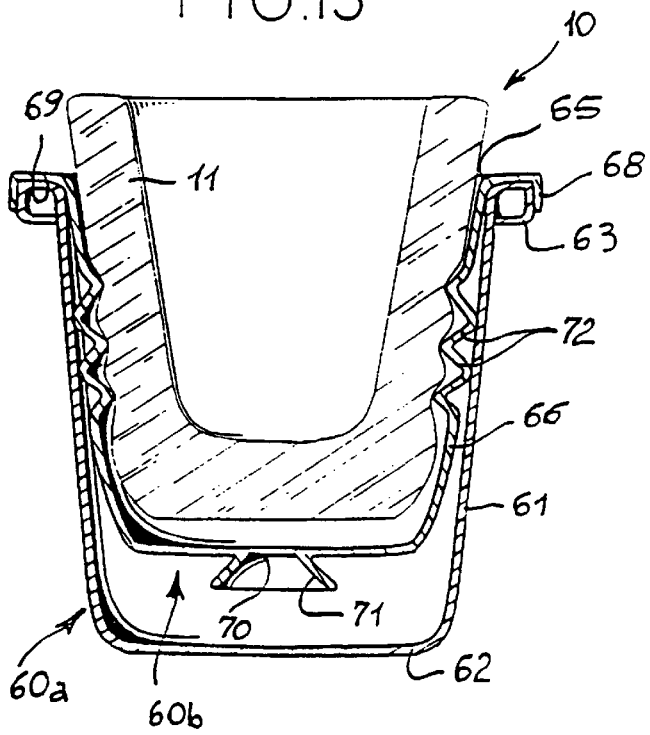
Figure 14:
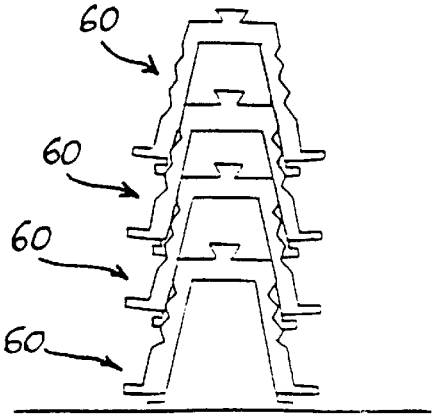
FIG. 14 shows, schematically and in section, a configuration of several of the male and female moulds of FIGS. 12 and 13 in the stacked condition, during the production of ice beakers.

FIGS. 12, 13 and 14 show an alternative system for the production and use of ice beakers in which moulds 60, for example, made of plastics material, preferably for "disposable" use, are provided, each mould comprising a male element 60*a* with a frusto-conical wall 61, a base 62, and an annular rim 63 which is turned outwards. The rim 63 is extended outwardly by an annular band 64 for connection to an opening 65 of a female element 60*b* also having a substantially frusto-conical wall 66 and a base 67. The annular connecting band 64 can be removed from the mould 60, for example, by means of a tab 64*a* so as to separate the male element 60*a* from the female element 60*b*, in use.

The female element 60*b* has an annular rim 68 bent like a hook to form an annular seat 69. The base 67 has a central hole 70 from which an annular flange 71 extends. The side wall 66 has a slight spiral corrugation 72 or, as already described with reference to the embodiment of FIGS. 7 to 9, a spiral programmed-deformation region.

As can be seen in FIG. 14, several moulds 60 can easily be stacked one upon another after the internal cavities defined by the male elements 60*a* and by the female elements 60*b* have been filled with water. The moulds thus filled and preferably stacked are placed in a freezer for the period of time necessary to freeze the water completely, forming ice beakers 10 housed in the moulds 60.

In order to use the ice beakers 10 to drink or sip a drink, it suffices to remove the annular connecting band 64 and thus to separate the male element 60*a* from the female element 60*b*, the side wall 66 of which is deformed as described above in order to form or to accentuate the spiral corrugation 72. When this is done, the ice beaker 10 emerges partially from the female element 60*b* and is spaced from the side wall 66 thereof. The female element 60*b* is then housed in the male container 60*a*, the annular rim 63 of which is fitted in the annular seat 69. The central hole 70 thus becomes the opening through which the water resulting from the progressive melting of the ice beaker 10 flows. The annular flange 71 prevents the water from escaping when the mould 60, which now has the function of a support for the ice beaker 10 is inclined for drinking.

Figure 15:
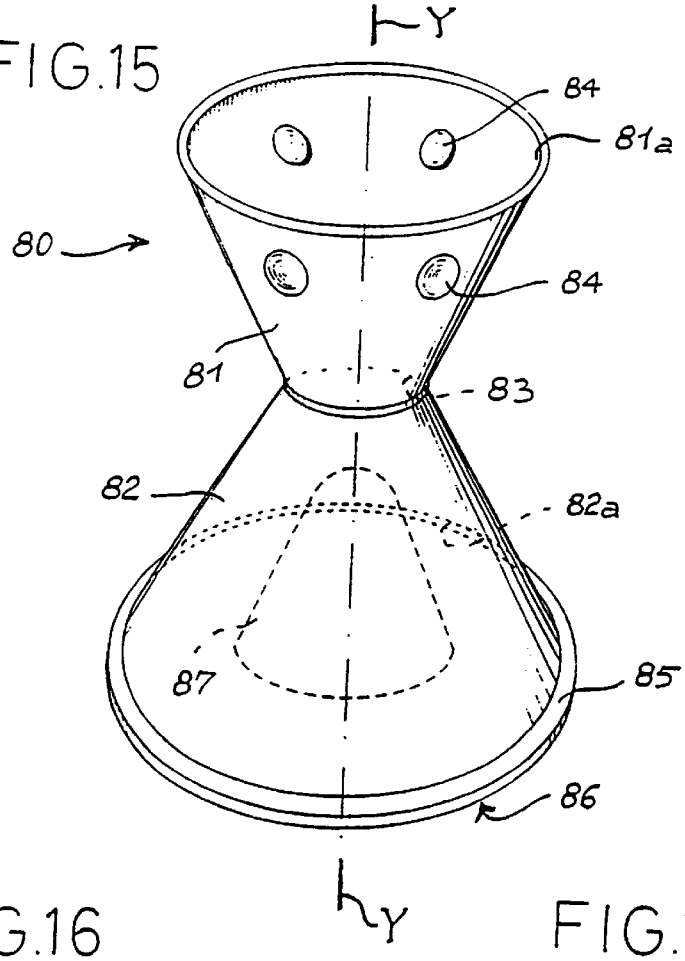
FIGS. 15 to 17 show various stages of the production and use of an ice beaker by means of a mould which also acts as a support for the beaker.
Figure 16:
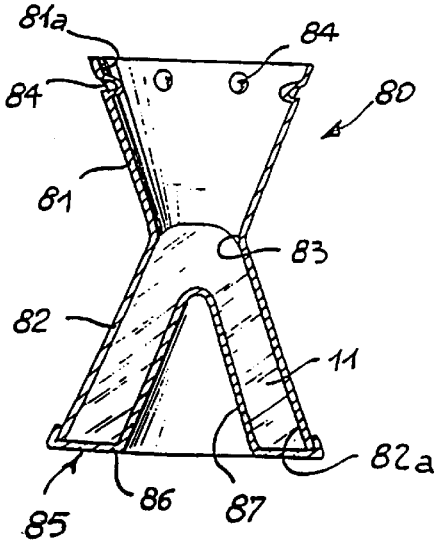
Figure 17:
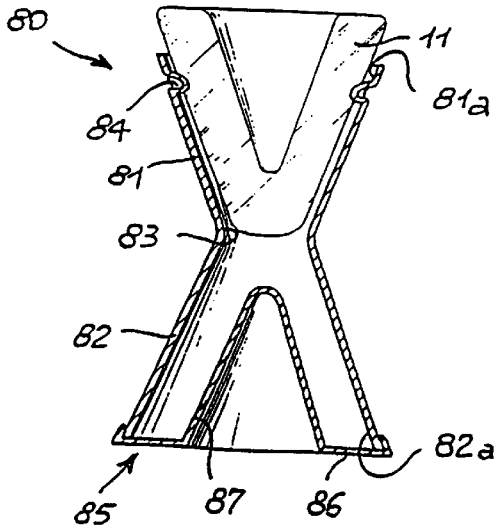

FIGS. 15, 16 and 17 show an alternative embodiment of the mould for ice beakers which can also be used as an ice-beaker support. In detail, the mould comprises a mail hourglass-shaped body 80 made, for example of metal such as stainless steel, or glass, plastics material, rubber, etc. In the preferred embodiment shown in the drawings the hourglass-shaped body 80 comprises two portions with frusto-conical walls, comprising an upper portion 81 and a lower portion 82 joined by a common base of least with which defines a central communication duct 83. The inclination of the frusto-conical walls to a common axis Y—Y is preferably identical for the two portions 81 and 82 which, however, again preferably but in non-limiting manner are of different heights and thus have respective mouths 81*a* and 82*a* of different diameters. Support members 84 for an ice beaker 10 are formed on the frusto-conical wall of the upper portion 81 the height of which is less than that of the lower portion 82. For example, the support members may be formed by moulding or by punching in a manner similar to that described above with reference to FIGS. 1 and 2. The hourglass-shaped body 80 may advantageously be formed by deformation of a tube.

The mould/support of FIGS. 15 to 17 further comprises a removable cap 85 with an annular wall 86 and a substantially conical re-entrant wall 87 the taper of which is similar to the inclination of the wall of the lower portion 82. The cap 85 is mounted in the mouth 82*a* of the lower portion 82 in a removable, leaktight manner by a connection of known type, for example, a screw, snap or pressure connection or a connection of another type, possibly with the interposition of a scaling member, for example a sealing ring.

In order to produce an ice beaker, it suffices to close the lower mouth 82*a* with the cap 85 and to pour through the upper mouth 81*a* a quantity of water such as practically to fill the lower portion 82 entirely or at least up to a level such that the top of the conical wall 87 of the cap 85 is well covered. As shown in FIG. 16 the water fills the space between the annular and conical walls 86 and 87 of the cap 85 and the side wall of the lower portion 82 which defines a beaker-shaped cavity. As the water freezes it thus forms an ice beaker 10 which can easily be removed from the mould by removing the cap 85 from the hourglass-shaped body 80. The beaker thus produced can subsequently be housed in the upper portion 81 of the hourglass-shaped body 80 which has the spacer and support means 84, after the lower mouth 82*a* has been closed by the cap 85. The water produced during the progressive melting of the ice beaker 10 collects in the lower portion 82 of the hourglass-shaped body 80 and, by virtue of the undercut of the side wall of the lower portion 82 relative to the upper portion 81, does not escape even when the support is inclined in order to drink from the ice beaker.

An advantageous characteristic of the support described above in the preferred embodiment shown in FIGS. 15 to 17, is that the water resulting from the complete melting of the ice beaker can be removed from the hourglass-shaped body without any trouble after use. In fact to do this, it suffices to invert the hourglass-shaped body 80 and/or to open the cap 85. The simplicity of the component parts of the mould/support which comprise large smooth surfaces also permits optimal cleaning thereof.

Figure 18:
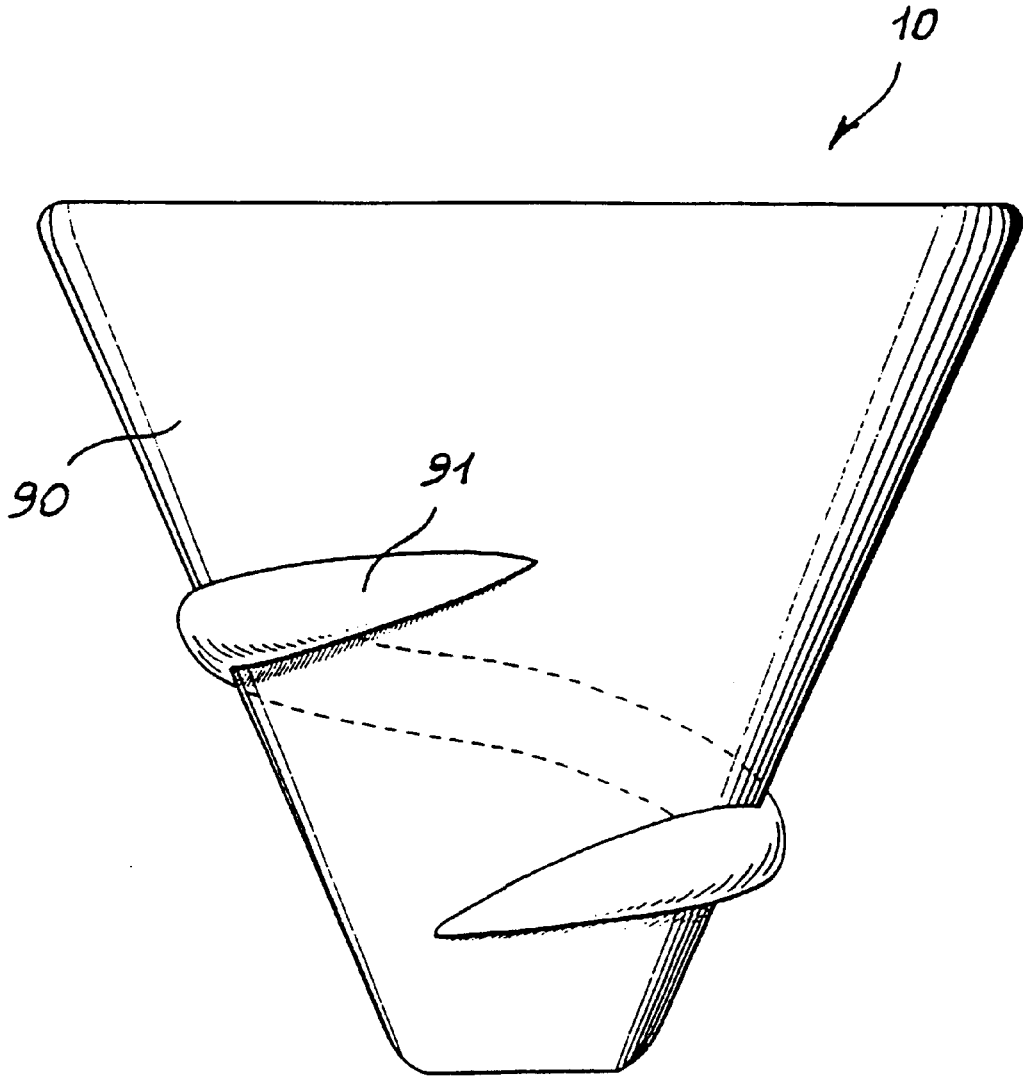
FIG. 18 is a front view showing an embodiment of an ice beaker comprising a helical ridge on its side wall.

Another alternative embodiment of the mould for ice beakers according to the present invention can produce ice beakers of the type illustrated in FIG. 18 in which the side wall 90 of the beaker 10 comprises a helical or spiral projection or ridge 91 formed by means of a corresponding recess on the side wall of the mould. The ridge 91 enables the ice beaker to be supported inside an outer support of the type illustrated, for example, in FIG. 4, in a manner such that the progressive melting of the ice beaker favours its engagement in the support reducing even further the risks of involuntary movements to and fro.

Naturally, the principle of the invention remaining the same, the forms of embodiment and details of construction may be varied widely with respect to those described and illustrated, without thereby departing from the scope of the present invention.

What is claimed is:

1. A support for an ice breaker comprising a cup-shaped body (16, 30, 40, 80) with a side wall (17, 41) and a base for collecting the water resulting from the progressive melting of an ice breaker (10) housed in the cup-shaped body (16, 30, 40, 80), the side wall (17, 41) comprising regions (19, 31, 72, 84) arranged in spaced apart relation to each other along the height of the side wall (10) when it is in the upright position, for supporting and restraining the outer wall of an ice beaker (10), wherein the regions further provide collecting means to direct the progressive melting water of the whole ice beaker towards the base of the support and stopping means to prevent the progressive melting water of the whole ice beaker (10) to escape therefrom.

2. A support or an ice beaker according to claim 1, characterized in that the supporting and restraining regions are defined by a spiral clement (31) with coils (32) projecting the side wall of the cup-shaped body.

3. A support for an ice beaker according to claim 2, characterized in that the spiral element (31) is made of a flexible material and is mounted inside the cup-shaped body fitting closely against its side wall by means of resilient lips (34).

4. A support for an ice beaker according to claim 3, each coil (32) of the spiral element (31) being spaced from the underlying coil by means of spacer elements (33).

5. A support for an ice beaker according to claim 2, characterized in that the spiral element is formed by corrugation of the side wall (41) of the cup-shaped body.

6. A support for an ice beaker according to claim 5, characterized in that the corrugation is produced by deformation, at the time of use, of the side wall (41) of the cup-shaped body which has programmed-deformation regions (44).

7. A support for an ice beaker according to claim 6, characterized in that, before use, the side wall (41) of the cup-shaped body (40) is substantially smooth to enable a plurality of cup-shaped bodies (40) to be fitted one inside another to facilitate their storage.

8. A support for an ice beaker according to claim 1, characterized in that it comprises a partition (20) of flexible material interposed between the region housing the ice beaker (10) and the base (18) of the cup-shaped body (16).

9. A support for an ice beaker according to claim 8, characterized in that the flexible partition (20) comprises an annular wall (22) which can be mounted selectively fitting tightly against the side wall (17) of the cup-shaped body (16), an annular lip (23) projecting from the annular wall (22) and being inclined towards the base (18) of the cup-shaped body (16).

10. A support for an ice beaker according to claim 9, characterized in that the flexible partition (20) farther comprises projecting appendages (25) which define peripheral ducts (26) for allowing water to drip from the ice beaker towards the annular lip (23) and then towards the base (18) of the cup-shaped body (16).

11. A support for an ice beaker according to claim 8, characterized in that the flexible partition (20) is made of silicone rubber suitable for use with foodstuffs.

12. A support for an ice beaker according to claim 1, characterized in that the support comprises mould members (60, 82) for the production of an ice beaker (10).

13. A support for an ice beaker according to claim 12, characterized in that the mould members (60) comprise at least one helical recess for forming a corresponding ridge (91) on the wall of an ice beaker (10).

14. A support for an ice beaker according to claim 12, characterized in that the mould members (60) comprise a male element (60*a*) and a female (60*b*) element joined together separably, the male and female elements defining a beaker-shaped cavity to be filled with water to be frozen to produce an ice beaker (10), the female element (60*b*) and the male element (60*a*) being separated and fitted together again in an inverted configuration in use in order to act as a body for housing the ice beaker (10), and as a body for collecting the water generated by the progressive melting of the ice beaker (10), respectively.

15. A support for an ice beaker according to claim 14, characterized in that the male element (60*a*) and the female element (60*b*) are joined together by a strip-like member (64) which is integral with the elements and can be removed therefrom by tearing.

16. A support for an ice beaker according to claim 14, characterized in that, in the configuration with the function of a mould (60), the supports can be stacked inside one another.

17. A support for an ice beaker according to claim 14, characterized in that the side wall (66) of the female element (60*b*) has programmed-deformation regions (72), a deformation of the side wall (66) of the female element (60*b*) brining about the formation of regions for supporting and restraining the ice beaker (10) and for causing the ice beaker (10) to emerge partially from the female element (60*b*), in use.

18. A support for an ice beaker according to claim 14, characterized in that the female element (60*b*) comprises a base (67) in which there is an opening (70) surrounded by an annular flange (71).

19. A support for an ice beaker according to claim 12, characterized in that the mould members comprise a side wall of the foot (82) of the cup-shaped body (80) defining a mouth (82*a*).

20. A support for an ice beaker according to claim 12, characterized in that the base is closed by a cap (85).

21. A support for an ice beaker according to claim 19, characterized in that the cap (85) comprises a central conical wall (87) and is mounted removably on the foot (82) of the cup-shaped body in order to close the mouth (82*a*) thereof.

22. A support for an ice beaker according to claim 1, characterized in that the cup-shaped body defines a first portion (81) of an hourglass-shaped body (80) including a second portion (82), the two portions comprising frusto-conical side walls defining two mouths (81*a*, 82*a*) one being a lower mouth (82*a*) and the other being an upper moth (81*a*), the lower mouth being closed selectively by a removable cap(85), the upper portion (81) being intended to house an ice beaker (10), and the lower portion (82) being intended at two distinct operative stages, for producing an ice beaker (10), and for collecting we water resulting from the progressive melting of an ice beaker (10) housed in the upper portion (81).

* * * * *